United States Patent [19]

Becnel

[11] 4,126,206

[45] Nov. 21, 1978

[54] LADDER GUARD

[75] Inventor: Bradly M. Becnel, Temple City, Calif.

[73] Assignee: Sunset Ladder Company, South El Monte, Calif.

[21] Appl. No.: 844,030

[22] Filed: Oct. 20, 1977

[51] Int. Cl.[2] ..... E06C 5/32

[52] U.S. Cl. ..... 182/129; 182/106; 182/230

[58] Field of Search ..... 182/230, 106, 121, 129

[56] References Cited

U.S. PATENT DOCUMENTS

| | | | |
|---|---|---|---|
| 3,225,863 | 12/1965 | Ludlow | 182/230 |
| 3,311,195 | 3/1967 | Singer | 182/230 |
| 3,372,772 | 3/1968 | Singer | 182/230 |

*Primary Examiner*—Reinaldo P. Machado
*Attorney, Agent, or Firm*—Donald D. Mon

[57] ABSTRACT

A guard to bar access to ladder rungs comprising a first and second rigid sheet pivoted together. The upper sheet has an upper hook to hang over a rung of the ladder. The lower (second) sheet has a joggle which enables a portion of it to pass behind a ladder rung and lock means to lock the second, lower, sheet to a rung whereby the first sheet and a portion of the second sheet bar access to the ladder rungs and the upper hook and the lock means prevent removal of the shield without first releasing the lock means.

6 Claims, 4 Drawing Figures

LADDER GUARD

This invention relates to a guard to bar access to ladder rungs.

Especially for ladders which are attached permanently to building structure, there is a need to bar access to the rungs in order to prevent unauthorized persons from climbing the ladder. Various types of sheathing and shielding have been suggested for this purpose but they have tended to be unnecessarily complex, expensive and difficult to install. For example, it is not uncommon for cabinets to be built around the lower end of a ladder with a door secured by a lock to prevent access to the ladder.

It is an object of this invention to provide a portable shield to bar access to the ladder rungs which can conveniently be attached to the ladder and which can as conveniently be removed when its lock means are released. The device according to the invention is simple to manufacture, and is relatively inexpensive.

A shield according to this invention comprises a first and second sheet, the lower edge of the first (upper) sheet being hingedly joined to the upper edge of the second (lower) sheet. The upper edge of the upper sheet hangs over a ladder rung to support the shield and also to prevent it from being pulled away from the ladder. The second, lower, sheet has a joggle permitting a portion of it to pass between two rungs to stand behind them. Releasable lock means on the other side of the joggle from the upper edge of the second sheet is provided for holding the second sheet to a ladder rung when the hook is over another ladder rung and the joggle passes between said two ladder rungs.

According to two preferred but optional features of this invention, the two sheets are rigid metal sheets, and the lock means comprises a clevis which embraces a ladder rung and is held engaged thereto by a pin and lock.

The above and other features of this invention will be fully understood from the following detailed description and the accompanying drawings in which.

Figure 1:
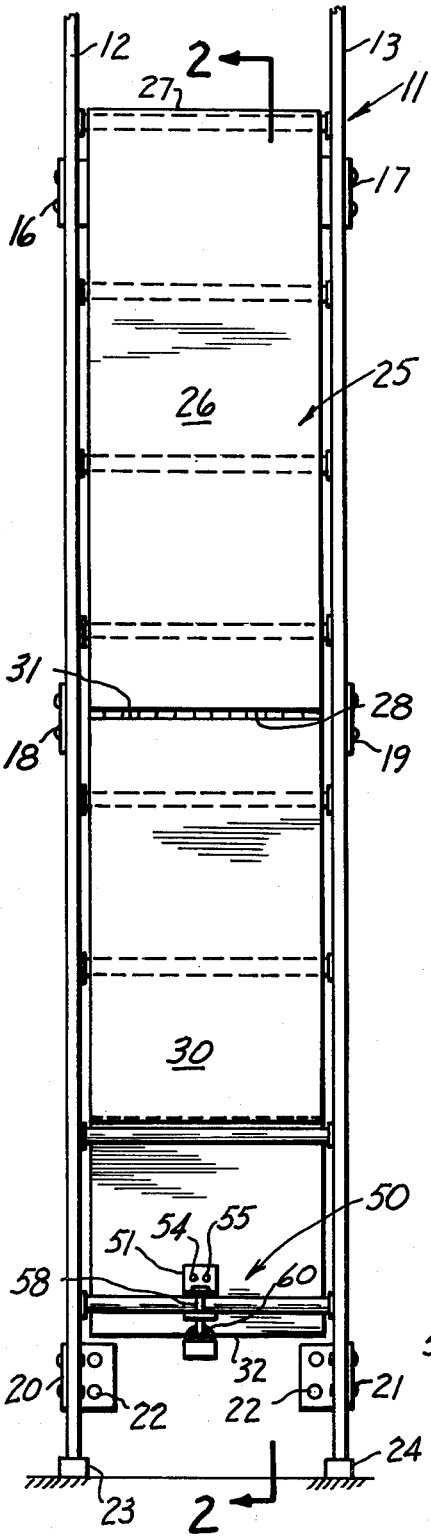
FIG. 1 is front view showing the invention installed.
Figure 2:
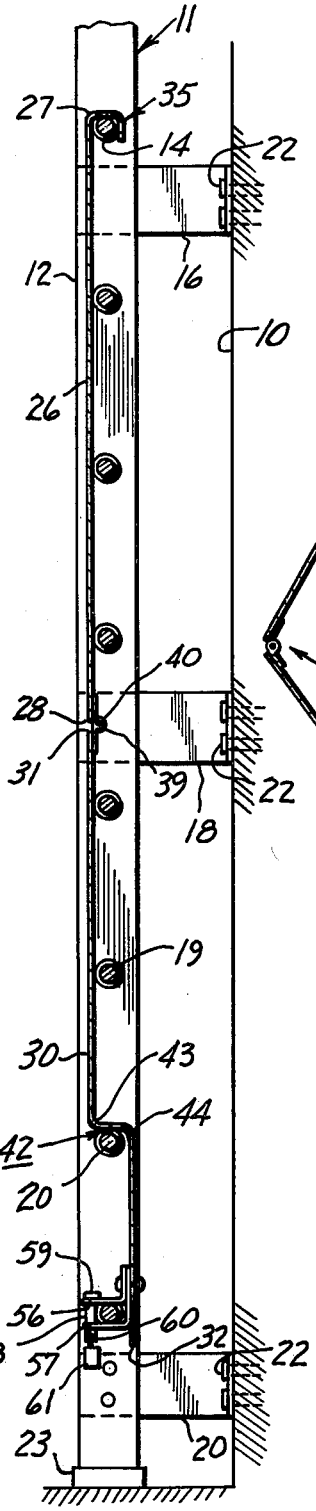
FIG. 2 is a cross-section taken at line 2—2 of FIG. 1.

FIGS. 1 and 2 show a building 10 to which a ladder 11 is mounted. The ladder includes a pair of side rails 12, 13 interconnected by a plurality of rungs 14–21 inclusive. There may of course be more or fewer rungs than these. The ladder is mounted to the building by flanged plates 16, 17, 18, 19, 20, 21 which are welded or otherwise attached to the side rail and held to the building by bolts 22. The rail rest on feet 23, 24.

A shield 25 according to the invention is shown in the drawings. It includes a first, upper, sheet 26 having an upper edge 27 and a lower edge 28. A second, lower, sheet 30 has an upper edge 31 and a lower edge 32.

The upper edge of sheet 26 carries a hook 35 which may conveniently be a "U" shaped channel 36 formed by making two bends 37, 38 in the material of the sheet. Optionally a simple hook member could be attached to the sheet. The lower edge 28 carries a portion of a hinge part 39.

Lower sheet 30 carries on its upper edge 31 a hinge part 40, which by means of a hinge pin 41 pivotally attaches the sheets to each other. The second sheet also includes a joggle 42 which conveniently is formed by two right angle bends 43, 44 enabling the sheet to be stepped over from in front of the rungs to behind the rungs.

Figure 3:
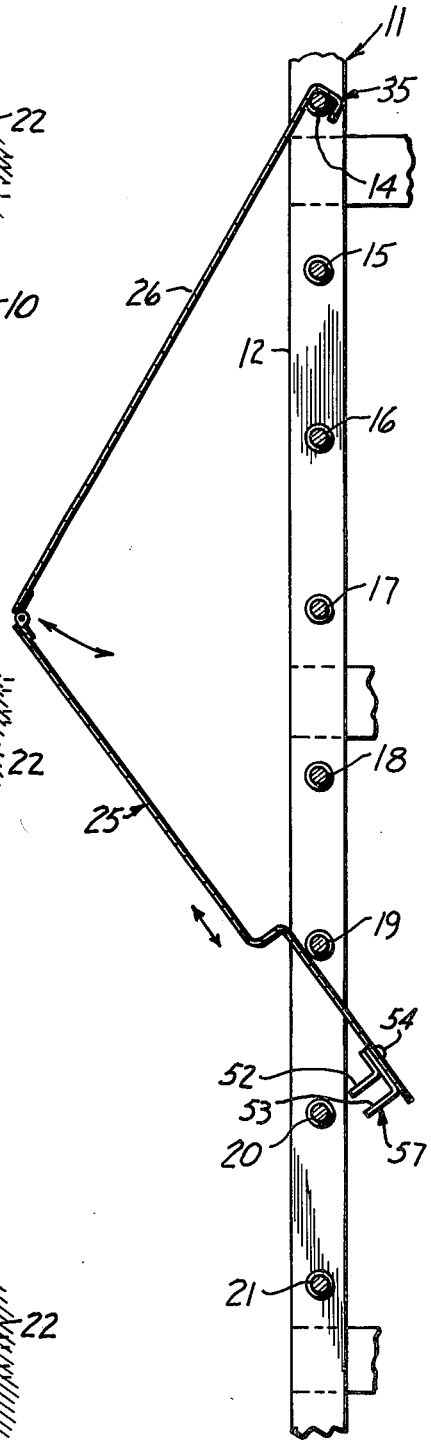
FIG. 3 is a fragmentary view of FIG. 2 showing the device in an intermediate position both of installation and removal.

Locks means 50 is formed on the second sheet on the opposite side of the joggle from the hinge part. It should be attachable to a rung by manipulations accomplished at the front. The presently preferred form is a clevis 51 having a pair of arms 52, 53 which may for example be a pair of right-angle, bent metal pieces attached to the lower sheet by rivets 54, 55. These arms have respective holes 56, 57 to pass a lock pin 58. The lock pin has a head 59 and a cross-hole 60 to receive the hasp of a padlock 61. The lock means is shown fastened in FIGS. 1 and 2 and released in FIG. 3.

Figure 4:
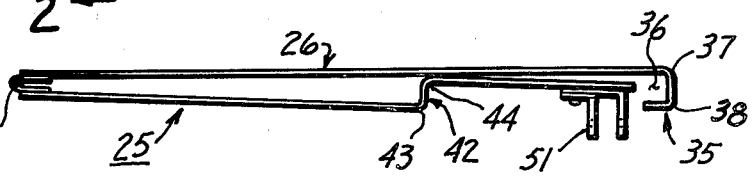
FIG. 4 shows the shield in its folded, stored, condition.

As can be seen from FIG. 4 this structure can be folded to a minimum size of about ½ its extended height, and of the width of the ladder between the rails. In the course of installation or removal, the hook is hooked over a rung such as rung 14, and the first upper sheet is swung upwardly around that rung as a center until the second lower sheet assumes a position where its end can pass between a pair of rungs such as between rungs 19 and 20. Then the first sheet can be brought down to a vertical position as shown in FIG. 2 and at the same time it will permit the relative rotation of the second sheet to the vertical position. The joggle now passes between rungs 19 and 20, and the arms of the clevis embrace rung 21. The lock means can then be fastened.

The removal is the opposite. The lock means first is released. Then the second sheet is swung counter-clockwise while raising the first sheet, and withdrawing the second sheet from between the two rungs. The first sheet can then simply be lifted off the rung from which the hook had overhung.

The drawing is substantially to scale. The drawings suitably show dimensions and proportions.

The precise embodiment of hinge means of hook and of lock means is immaterial to this invention. Any desired hinge can be substituted for the piano-type hinge which is shown therein. Independently attached hooks maybe substituted for the bent portion of the upper sheet for the hook. Instead of a lock means having a portion permanently attached to the second sheet, it is possible to provide a lock means which embraces the rung and attaches to some part of the second sheet instead. All of these and other suitable modifications are within the scope of this invention.

This device therefore comprises a simple, inexpensive, and expedient means for barring access to ladder rungs, while still permitting ready removal of the guard to permit such access.

This invention is not to be limited by the embodiment shown in the drawings and described in the description which is given by way of example and not of limitation, but only in accordance with the scope of the appended claims.

I claim:

1. A guard to bar access to ladder rungs comprising: a first sheet having an upper and lower edge, a hook on said upper edge for engaging a ladder rung from a front face of the ladder, a hinge part on said lower edge; a second sheet having a upper and a lower edge, a hinge part on said upper edge forming with said hinge part on said first sheet a hinged joinder of the two sheets at the respective edges; a joggle in the second sheet between its said edges; and releasable lock means on the other side of the joggle from the upper edge of the second sheet for holding the second sheet to a ladder rung when the hook is over a ladder rung, and the joggle passes between two ladder rungs, whereby to hold the first sheet and at least part of the second sheet in front of the ladder rungs and prevent the removal of the guard unless the lock means is released.

2. A guard according to claim 1 in which the sheets are substantially rectangular.

3. A guard according to claim 1 in which the hinge part extends substantially entirely across the width of said two sheets.

4. The guard according to claim 1 in which the lock means comprises a clevis carried by said second sheet, and means across the clevis to a ladder ring inside the clevis.

5. A guard according to claim 1 in which the hook is formed integrally with the upper end of the first sheet.

6. In combination: a guard according to claim 1 and a ladder comprising a pair of rails and a plurality of rungs interconnecting the rails, the hook being adapted to hook over one of the rungs and the lower edge of the second sheet being adapted to pass between two rungs so a portion on the other side of said joggle from the hinge means can be placed behind at least one of the rungs.

* * * * *